US006514577B2

(12) United States Patent
Tomiyama

(10) Patent No.: US 6,514,577 B2
(45) Date of Patent: Feb. 4, 2003

(54) SURFACE TREATMENT METHOD FOR A CONTACT PORTION OF A DIAPHRAGM SPRING

(75) Inventor: Kimihiro Tomiyama, Neyagawa (JP)

(73) Assignee: Exedy Corporation, Osaka (JP)

( * ) Notice: Subject to any disclaimer, the term of this patent is extended or adjusted under 35 U.S.C. 154(b) by 0 days.

(21) Appl. No.: 10/153,812

(22) Filed: May 24, 2002

(65) Prior Publication Data

US 2002/0187275 A1 Dec. 12, 2002

(30) Foreign Application Priority Data

Jun. 6, 2001 (JP) ..... 2001-170874

(51) Int. Cl.[7] ..... H01T 14/00

(52) U.S. Cl. ..... 427/580; 427/327; 427/328; 427/346; 427/347; 427/399; 427/405; 427/419.7; 427/591

(58) Field of Search ..... 427/580, 591, 427/399, 405, 419.7, 327, 328, 346, 347

(56) References Cited

U.S. PATENT DOCUMENTS

| | | | | |
|---|---|---|---|---|
| 4,834,640 A | * | 5/1989 | Inoue et al. | 425/464 |
| 5,779,018 A | * | 7/1998 | Hofmann et al. | 192/70.14 |
| 6,086,684 A | * | 7/2000 | Saito et al. | 148/220 |
| 6,395,109 B1 | * | 5/2002 | Peppler et al. | 148/335 |

* cited by examiner

*Primary Examiner*—Bernard Pianalto
(74) *Attorney, Agent, or Firm*—Shinjyu Global IP Counselors, LLP

(57) ABSTRACT

A surface treatment method that increases the wear resistance of contact portions of levers of a diaphragm spring in a clutch cover assembly and of a plate member that slides there-against is provided. The surface treatment method is applied to the contact portions of the diaphragm spring of the clutch cover assembly and to the plate member that slides there-against. In this method, the contact portion of the diaphragm spring and the sliding portion of the plate member are designated as treatment surfaces. The treatment surfaces are subjected to an electric discharge coating using a coating material such that the treatment surface is covered with a coating layer of approximately 50 $\mu$m or less and a diffusion layer is formed inside the treatment surface.

20 Claims, 5 Drawing Sheets

(a)

(b)

(a)

(b)

(a)

(b)

SURFACE TREATMENT METHOD FOR A CONTACT PORTION OF A DIAPHRAGM SPRING

BACKGROUND OF THE INVENTION

1. Field of the Invention

The present invention relates to a surface treatment method. More specifically, the present invention relates to a surface treatment method for a contact portion of a diaphragm spring and a plate member that slides there-against.

2. Background Information

Clutches are designed to transfer and interrupt torque from an engine to a transmission in a vehicle or the like. Conventionally, clutches are equipped with a clutch cover assembly for pressing and releasing a clutch disk against and from a flywheel. The clutch cover assembly chiefly has a pressure plate, a diaphragm spring or coil spring, and a clutch cover. The pressure plate pinch-holds the clutch disk between itself and the flywheel. The diaphragm spring or coil spring presses the pressure plate against the clutch disk. The clutch cover is fixed to the flywheel and supports the spring and pressure plate.

A conventional diaphragm spring used in a diaphragm spring type clutch cover assembly has a ring-shaped elastic part and a plurality of lever parts that extends radially inward from the elastic part. A release bearing or other release member touches against the contact portion of the tips of the levers of the diaphragm spring through the plate member. The pressure exerted on the pressure plate by the diaphragm spring is applied and removed—and the clutch is engaged and disengaged—in accordance with the axial movement of the release member. Thus, the tip sections of the levers of the diaphragm spring are a contact portion that is moved by the release member through the plate member. The tip sections slide on the plate member each time the clutch is engaged and disengaged. Therefore, measures against wear are conventionally taken with respect to the sliding portions. For example, in addition to induction hardening, the metal surfaces of the sliding portions are plated with hard chrome or thermal-sprayed with a molybdenum coating. The adhesion between the hard chrome plating and the base material is not particularly high. Thus, the plating cracks and exfoliates when large loads act thereon. Furthermore, the chrome plating process generates chromium VI, which is considered to be environmentally unfriendly. When molybdenum thermal spraying is used, insufficient adhesion results from the existence of porosity and, consequently, sufficient wear resistance cannot be obtained.

In view of the above, there exists a need for a surface treatment method for a contact portion of a diaphragm spring and a plate member that slides there-against that overcomes the above-mentioned problems in the prior art. This invention addresses this need in the prior art as well as other needs, which will become apparent to those skilled in the art from this disclosure.

SUMMARY OF THE INVENTION

An object of the present invention is to provide a surface treatment method that increases the wear resistance of the tip sections or contact portions of the levers of the diaphragm spring in a clutch cover assembly and of the plate member that slides there-against.

A surface treatment method in accordance with a first aspect of the present invention is a surface treatment method for a contact portion of a diaphragm spring in a clutch cover assembly and/or a plate member that slides there-against. In this method, the contact portion of the diaphragm spring and/or the sliding portion of the plate member are/is designated as a treatment surface. The treatment surface is subjected to an electric discharge coating treatment using a coating material such that the treatment surface is covered with a coating layer of approximately 50 μm or less and a diffusion layer is formed inside the treatment surface.

In contrast to conventional methods, this method is not limited to forming a coating layer on the plate member and the contact portion of the diaphragm spring. This method also forms a diffusion layer, or a layer formed by the coating material diffusing/penetrating into of the treatment surface, inside the treatment surface by means of electric discharge coating. Thus, the adhesion between the coating layer and the base material is improved. In other words, the adhesion between the coating layer and the contact portion of the diaphragm spring or the sliding portion of the plate member is improved. As a result, the wear resistance is improved. Additionally, since the thickness of the coating layer covering the treatment surface is approximately 50 μm or less, the formation of unnecessary coating is suppressed while obtaining sufficient wear resistance to satisfy the service life of the clutch.

A surface treatment method in accordance with a second aspect of the present invention is a surface treatment method according to the first aspect, wherein the treatment surface is covered with a coating layer of approximately 10 to 50 μm.

A surface treatment method in accordance with a third aspect of the present invention is a surface treatment method according to the first or second aspect, wherein the treatment surface is covered with a coating layer having an average thickness of 20 to 40 μm.

A surface treatment method in accordance with a fourth aspect of the present invention is a surface treatment method as recited in any of the first to third aspects, wherein the coating material is molybdenum, tungsten carbide, titanium carbide, chromium carbide, or titanium boride.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 2(*b*) is an enlarged cross-sectional view of a treatment surface treated using a surface treatment method in accordance with a preferred embodiment of the present invention;

FIG. 3(*b*) is an enlarged cross-sectional view of a treatment surface treated using conventional thermal spraying;

FIG. 4(*b*) is an enlarged cross-sectional view of a treatment surface treated using conventional hard chrome plating.

DETAILED DESCRIPTION OF THE PREFERRED EMBODIMENTS

Figure 5:
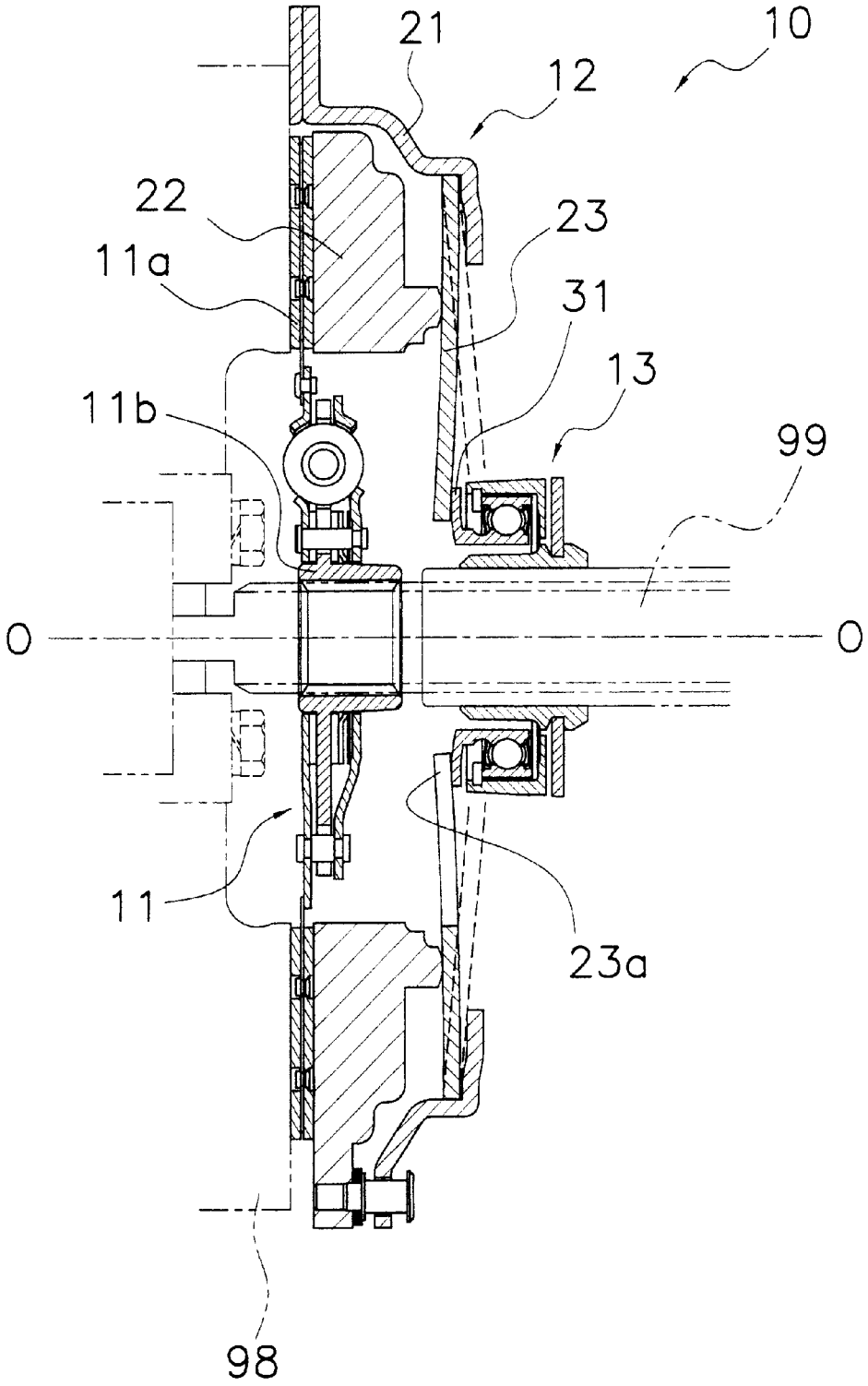
FIG. 5 is a schematic cross-sectional view of a clutch that includes a diaphragm spring and plate member treated with an electric discharge coating.

FIG. 5 shows an example of a clutch 10 that includes a diaphragm spring 23 and a plate member 31 that improve wear resistance using a surface treatment method in accordance with a preferred embodiment of the present invention. The clutch 10 shown in FIG. 5 is the type that is engaged by pushing on radially inner tips of the diaphragm spring 23. The surface treatment method of the present invention provides the same effect when applied to a clutch that is disengaged by pushing or pulling the radially inner tips of the diaphragm spring or is engaged by pulling on the radially inner tips of the diaphragm spring.

Constituent Features of the Clutch

The clutch 10 shown in FIG. 5 has rotational axis O—O. The clutch 10 serves to connect and disconnect the transmission of torque from a flywheel 98 on an engine side (left side of FIG. 5) to a main drive shaft 99 on a transmission side (right side of FIG. 5). The clutch 10 chiefly has a clutch disk assembly 11 and a clutch cover assembly 12. The outer circumference of the clutch 10 is covered by the clutch cover 21.

A frictional coupling section 11*a* of the clutch disk assembly 11 is disposed between the flywheel 98 and the pressure plate 22 of the clutch disk assembly 12. The frictional coupling section 11*a* is pinched between the pressure plate 22 and the flywheel 98 when the clutch 10 is engaged. A spline hub 11*b* of the clutch disk assembly 11 is splined to the outside of the main drive shaft 99.

The clutch cover assembly 12 includes a clutch cover 21, a pressure plate 22, the diaphragm spring 23, and straps (not shown). The straps connect the outer circumferential portion of the clutch cover 21 to the outer circumferential portion of pressure plate 22.

The diaphragm spring 23 preferably has a ring-shaped part and a plurality of levers that extend radially inward from the ring-shaped part. The diaphragm spring 23 rotates integrally with the clutch cover 21. An outer portion of the diaphragm spring 23 that faces the transmission touches against the clutch cover 21. A radially intermediate portion of the diaphragm spring 23 touches against pressure plate 22. Contact portions 23*a* at the tips of the levers of the diaphragm spring 23 touch against a plate member 31 of a release assembly 13. The release assembly 13 includes a release bearing and serves to move the lever tips of diaphragm spring 23 along axis O—O, thereby engaging and disengaging the clutch 10.

Clutch Operation

Clutch Engagement

When the release assembly 13 applies a prescribed load on the contact portions 23*a* of the diaphragm spring 23, the pressure plate 22 pushes the frictional coupling section 11*a* of the clutch disk assembly 11 toward the engine. Thus, the frictional coupling section 11*a* and the flywheel 98 become frictionally coupled together. As a result, torque from the flywheel 98 is transmitted to the clutch disk assembly 11 and delivered to main drive shaft 99, which is coupled to the spline hub 11*b* of the clutch disk assembly 11.

Clutch Disengagement

When the release assembly 13 moves toward the transmission while the clutch 10 is in the engaged condition shown in FIG. 5, the pushing load applied by the diaphragm spring 23 on the pressure plate 22 is released. The force exerted by the strap plate connecting the outer circumferential portion of the clutch cover 21 to the outer circumferential portion of the pressure plate 22 causes the pressure plate 22 to move toward the transmission. As a result, the frictional coupling section 11*a* of the clutch disk assembly 11 separates from the flywheel 98 and the clutch 10 disengages.

Surface Treatment of Sliding Portions of Diaphragm Spring and Plate Member

The contact portions 23*a* of the lever tips of the diaphragm spring 23 slide with respect to the plate member 31 of the release assembly 13 each time the clutch 10 is engaged or disengaged. In this embodiment, these sliding portions are treated according to the following procedure in order to impart wear resistance.

First, the sliding portions are preferably made of carbon steel and are treated with induction hardening. This causes the surface layer to adopt a martensite structure having a high degree of hardness.

The sliding portions are then treated with an electric discharge coating. The electric discharge coating treatment moves electrode material to the base material or sliding portion by means of an arc discharge. In addition to forming an electric discharge coating layer on the base material, a diffusion layer that contacts the electric discharge coating layer is formed in the vicinity of the surface of the base material. The electrode material or coating material that forms the electric discharge coating layer is preferably molybdenum in this embodiment, but tungsten carbide, titanium carbide, chromium carbide, or titanium boride can also be used.

During the electric discharge coating treatment, the electrode material is mounted on the electrode and rotated while being moved sequentially over the base material. The electrode repeatedly releases short discharges lasting $10^{-6}$ to $10^{-5}$ second at a frequency of every $10^{-3}$ to $10^{-1}$ second. As a result, the electrode material is heated to 8000 to 25,000° C. at the portion that contacts the base material and is moved to the surface of the base material in a plasma ionized state. The electrode material also diffuses/penetrates below the surface of the base material. The portion where the electrode material contacts the base material is constantly shrouded in a shield gas. Thus, an electric discharge coating layer and a diffusion layer are formed on the surface of the base material. A cross-sectional view of the surface of a base material that has undergone such an electric discharge coating treatment is shown in FIG. 1.

Figure 1:
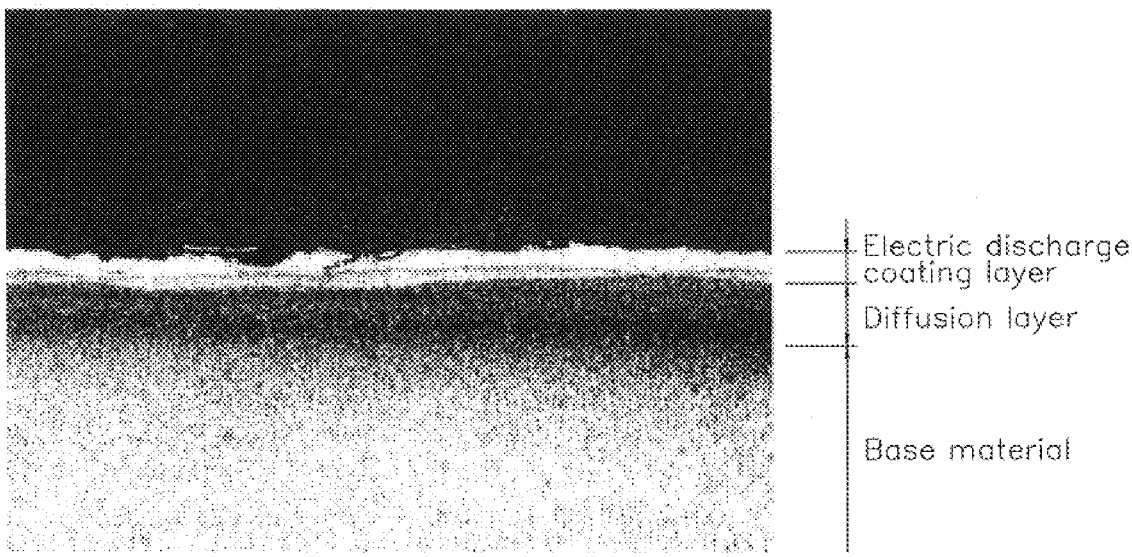
FIG. 1 is a cross-sectional view of a treatment surface treated using a surface treatment method in accordance with a preferred embodiment of the present invention.

Here, referring to FIGS. 1 and 5, the electric discharge coating treatment applied to the contact portion 23*a* of the tips of the levers of the diaphragm spring 23 and the sliding portion of the plate member 31 of the release assembly 13 targeted a coating thickness of 30 $\mu$m. An electric discharge coating having a maximum coating thickness of 32.2 $\mu$m and a minimum coating thickness of 18.4 $\mu$m was achieved. When a target coating thickness was attempted by thermally spraying molybdenum using a conventional method, a maximum coating thickness of 52.5 $\mu$m and a minimum coating thickness of 7.5 $\mu$m were obtained. Additionally, the surface roughness obtained with electric discharge coating was approximately one-third that obtained with molybdenum thermal spraying.

Characteristics of the Electric Discharge Coating Treatment of This Embodiment

Figure 3:
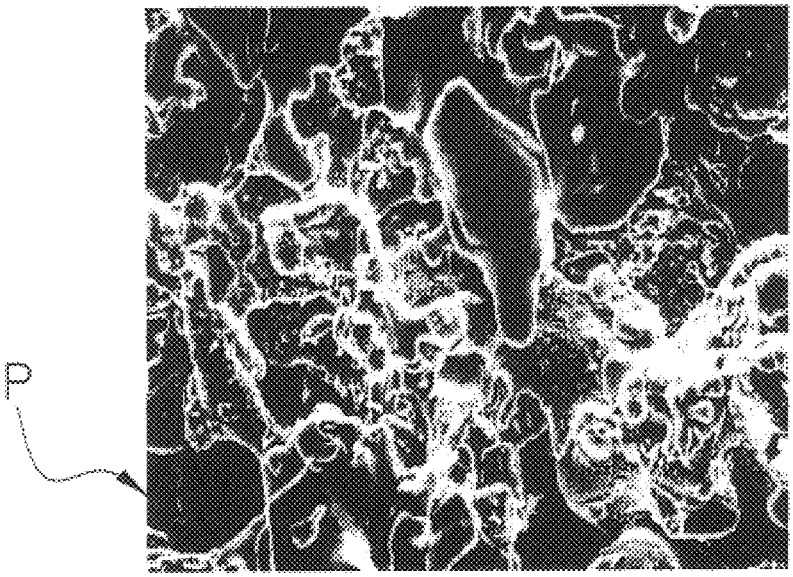
FIG. 3(*a*) is an enlarged elevational view of a treatment surface treated using conventional thermal spraying.
Figure 3:
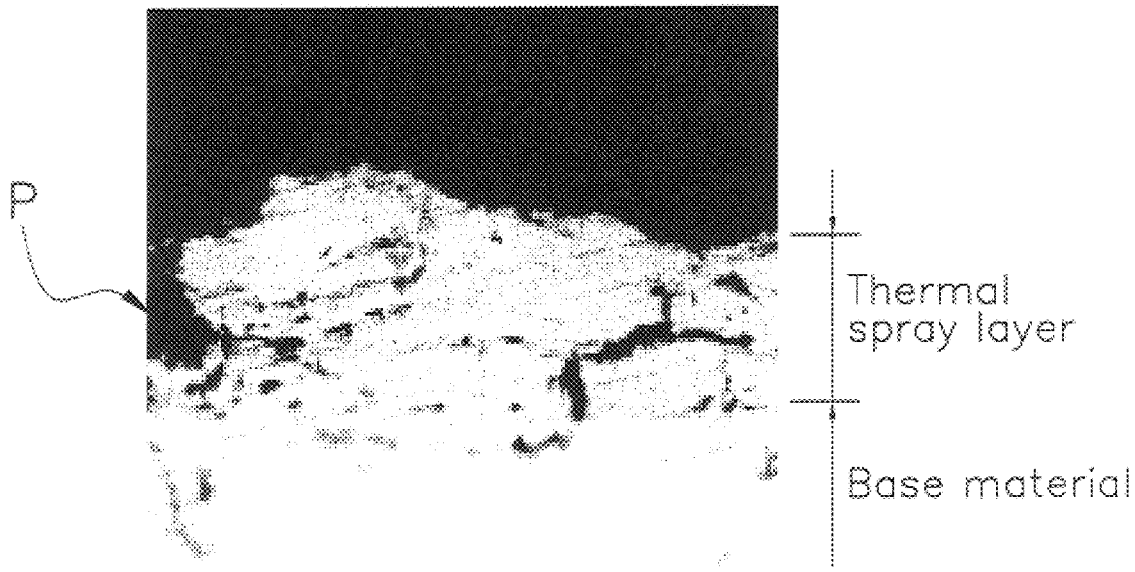
Figure 4:
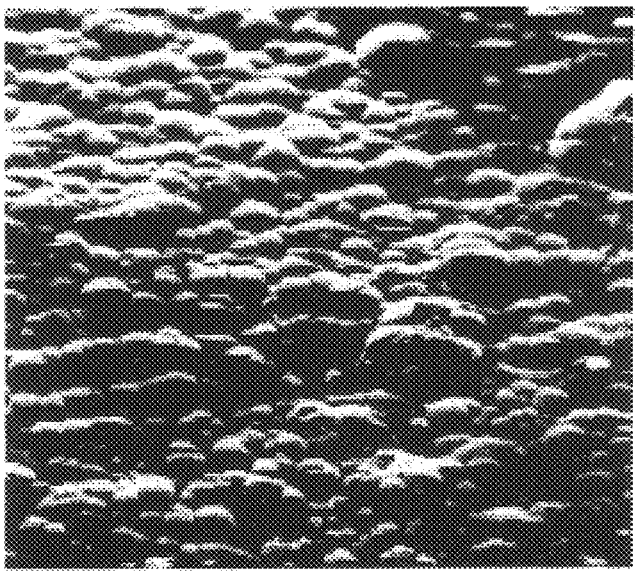
FIG. 4(*a*) is an enlarged elevational view of a treatment surface treated using conventional hard chrome plating.
Figure 4:
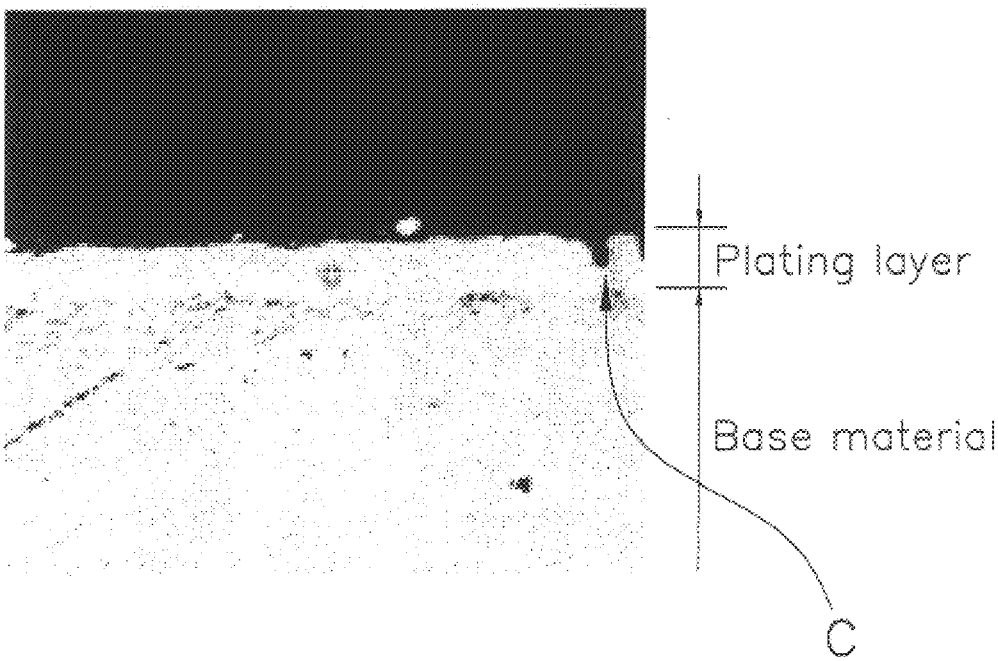

An enlarged surface view and enlarged cross-sectional view of a member surface treated with conventional molybdenum thermal spraying are shown in FIG. 3(*a*) and FIG. 3(*b*). An enlarged surface view and enlarged cross-sectional view of a member surface treated with a conventional hard chrome plating are shown in FIG. 4(*a*) and FIG. 4(*b*). As seen in FIGS. 3(*a*) and 3(*b*), molybdenum thermal spray suffers from a porosity P. As seen in FIGS. 4(*a*) and 4(*b*), hard chrome plating suffers from cracking C. Additionally, both of the aforementioned thermal spray and plating surface treatment layers are at risk of exfoliating.

Figure 2:
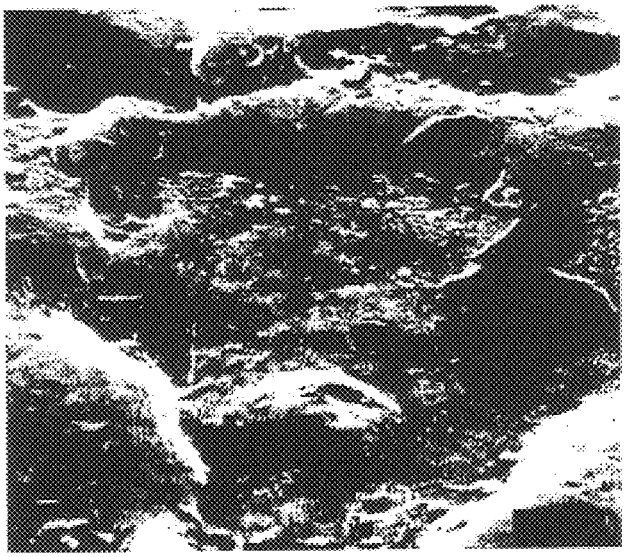
FIG. 2(*a*) is an enlarged elevational view of a treatment surface treated using a surface treatment method in accordance with a preferred embodiment of the present invention.
Figure 2:
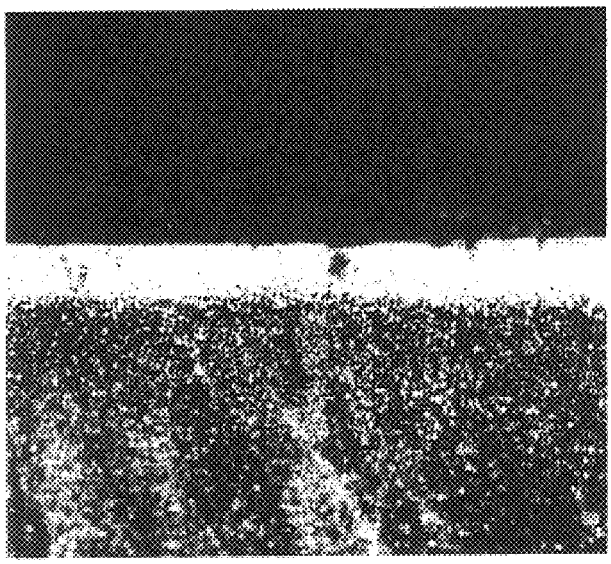

In contrast to conventional methods, as shown in FIG. 2(*a*) and FIG. 2(*b*), electric discharge coating in accordance with the present invention provides a coating treatment that has few pores and cracks. Additionally, as seen in FIG. 1, since a diffusion layer is formed between the base material and the electric discharge coating layer, the adhesion between the base material and the electric discharge coating layer is improved over conventional methods. As a result, the risk of the layer i.e., the electric discharge coating layer, that covers the base material exfoliating is extremely small and thus, the wear resistance improves. Sufficient wear resistance to satisfy the service life of the clutch 10 shown in FIG. 5 can be obtained by coating the base material (treatment surface of sliding portion) with an electric discharge coating layer having an average coating thickness of 20 to 40 $\mu$m with an actual coating thickness ranging from 10 to 50 $\mu$m.

EFFECTS OF THE INVENTION

The present invention is not limited to forming a coating layer on the plate member and the contact portion of the diaphragm spring. The present invention also forms a diffusion layer inside the treatment surface by means of an electric discharge coating. In other words, in accordance with the present invention, a layer is formed by the coating material diffusing/penetrating into the treatment surface inside the treatment surface by means of an electric discharge coating. Thus, the adhesion between the coating layer and the base material (the contact portion of the diaphragm spring or the sliding portion of the plate member) improves and the wear resistance increases. Also, since the thickness of the coating layer covering the treatment surface is approximately 50 $\mu$m or less, the formation of unnecessary coating is suppressed while obtaining sufficient wear resistance to satisfy the service life of the clutch.

The terms of degree such as "substantially," "about," and "approximately" as used herein mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2001-170874. The entire disclosure of Japanese Patent Application No. 2001-170874 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A surface treatment method for a contact portion of a diaphragm spring of a clutch cover assembly comprising:

designating the contact portion of the diaphragm spring of said plate member as a treatment surface;

subjecting said treatment surface to an electric discharge coating treatment using a coating material to cover with a coating layer of approximately 50 $\mu$m or less; and forming a diffusion layer inside said treatment surface.

2. The surface treatment method according to claim 1, wherein said coating layer is approximately 10 to 50 $\mu$m.

3. The surface treatment method according to claim 2, wherein said coating layer has an average thickness of 20 to 40 $\mu$m.

4. The surface treatment method according to claim 3, wherein said coating material is selected from the group consisting of molybdenum, tungsten carbide, titanium carbide, chromium carbide, and titanium boride.

5. The surface treatment method according to claim 2, wherein said coating material is selected from the group consisting of molybdenum, tungsten carbide, titanium carbide, chromium carbide, and titanium boride.

6. The surface treatment method according to claim 1, wherein said coating layer has an average thickness of 20 to 40 $\mu$m.

7. The surface treatment method according to claim 6, wherein said coating material is selected from the group consisting of molybdenum, tungsten carbide, titanium carbide, chromium carbide, and titanium boride.

8. The surface treatment method according to claim 1, wherein said coating material is selected from the group consisting of molybdenum, tungsten carbide, titanium carbide, chromium carbide, and titanium boride.

9. A surface treatment method comprising:

designating a contact portion of a clutch cover assembly diaphragm spring;

treating said contact portion with an electric discharge coating to form a coating layer, said coating laying being approximately 50 $\mu$m or less; and forming a diffusion layer contacting said coating layer.

10. The surface treatment according to claim 9, wherein said contact portion comprises carbon steel.

11. The surface treatment according to claim 10, wherein said carbon steel has been treated with induction hardening.

12. The surface treatment according to claim 11, wherein said electric discharge coating is formed by subjecting said contact portion to an electrode discharge lasting $10^{-6}$ to $10^{-5}$ second.

13. The surface treatment method according to claim 12, wherein said coating layer is approximately 10 to 50 $\mu$m.

14. The surface treatment method according to claim 13, wherein said coating layer has an average thickness of 20 to 40 $\mu$m.

15. The surface treatment method according to claim 14, wherein said coating material is selected from the group consisting of molybdenum, tungsten carbide, titanium carbide, chromium carbide, and titanium boride.

16. The surface treatment method according to claim 9, wherein said coating layer is approximately 10 to 50 $\mu$m.

17. The surface treatment method according to claim 16, wherein said coating layer has an average thickness of 20 to 40 $\mu$m.

18. The surface treatment method according to claim 17, wherein said coating material is selected from the group consisting of molybdenum, tungsten carbide, titanium carbide, chromium carbide, and titanium boride.

19. The surface treatment method according to claim 18, wherein said contact surface is heated to 8,000 to 25,000° C. during said treating said contact portion with said electric discharge.

20. The surface treatment method according to claim 19, wherein said contact surface is annular and rotated at a frequency of $10^{-3}$ to $10^{-1}$ second to facilitate said treating of said contact portion with said electric discharge coating.

* * * * *